US009787014B2

(12) United States Patent
Nagasawa

(10) Patent No.: US 9,787,014 B2
(45) Date of Patent: Oct. 10, 2017

(54) CONNECTOR

(71) Applicant: YAZAKI CORPORATION, Tokyo (JP)

(72) Inventor: Masanori Nagasawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/262,765

(22) Filed: Sep. 12, 2016

(65) Prior Publication Data

US 2017/0077636 A1 Mar. 16, 2017

(30) Foreign Application Priority Data

Sep. 16, 2015 (JP) ..... 2015-182525

(51) Int. Cl.
*H01R 13/436* (2006.01)
*H01R 13/11* (2006.01)

(52) U.S. Cl.
CPC ..... *H01R 13/4362* (2013.01); *H01R 13/111* (2013.01)

(58) Field of Classification Search
CPC ..... H01R 13/5362; H01R 13/111
USPC ..... 439/595
See application file for complete search history.

(56) References Cited

U.S. PATENT DOCUMENTS 5,098,315 A * 3/1992 Scowen ..... H01R 13/5221 439/587
5,167,534 A * 12/1992 Ohsumi ..... H01R 13/4362 439/595
5,595,509 A * 1/1997 Fry ..... H01R 13/4362 439/595
5,797,772 A * 8/1998 Sakurai ..... H01R 13/4362 439/752
5,830,013 A * 11/1998 Saito ..... H01R 13/4362 439/595
6,358,102 B1 * 3/2002 Fukamachi ..... H01R 13/4362 439/752
6,527,583 B2 * 3/2003 Plate ..... H01R 13/4362 439/157

(Continued)

FOREIGN PATENT DOCUMENTS

JP 2015-90830 A 5/2015

*Primary Examiner* — Alexander Gilman
(74) *Attorney, Agent, or Firm* — Kenealy Vaidya LLP

(57) ABSTRACT

A connector includes a terminal, a connector housing, and an engaging member. The terminal includes a cylindrical connecting section and a pair of uprise walls. The terminal is accommodated in a terminal accommodating chamber of the connector housing. The engaging member includes a terminal guide/engaging section. The terminal guide/engaging section has circular arc-shaped curved surfaces formed along the direction perpendicular to the inserting direction and an apex formed continuously with the circular arc-shaped curved surfaces between the adjacent circular arc-shaped curved surfaces, the circular arc-shaped curved surfaces being able to induce the terminal to an inserting completion position toward the terminal accommodating chamber when the engaging member is at the temporary engaging position, the terminal guide/engaging section engaging the terminal with the apex disposed on a position to project toward the bottom wall between the pair of uprise walls when the engaging member is at the final engaging position.

3 Claims, 14 Drawing Sheets

(56) References Cited

U.S. PATENT DOCUMENTS

| | | | | |
|---|---|---|---|---|
| 6,568,948 | B2 * | 5/2003 | Matsuoka | H01R 13/4361 439/271 |
| 6,616,481 | B2 * | 9/2003 | Ichio | H01R 13/4361 439/595 |
| 6,659,797 | B2 * | 12/2003 | Ichio | H01R 13/4361 439/595 |
| 6,702,625 | B2 * | 3/2004 | Endo | H01R 13/4362 439/752 |
| 6,749,469 | B2 * | 6/2004 | Matsuoka | H01R 13/62911 439/752 |
| 6,821,160 | B2 * | 11/2004 | Fink | H01R 13/512 439/595 |
| 7,114,999 | B2 * | 10/2006 | Tsuji | H01R 13/4362 439/752 |
| 7,500,887 | B2 * | 3/2009 | Ichio | H01R 13/4362 439/595 |
| 7,544,081 | B2 * | 6/2009 | Lim | H01R 13/4361 439/352 |
| 7,559,808 | B2 * | 7/2009 | Nishide | H01R 13/4362 439/595 |
| 7,762,854 | B1 * | 7/2010 | Peng | H01R 13/508 439/578 |
| 7,828,581 | B2 * | 11/2010 | Okayasu | H01R 13/4362 439/352 |
| 8,491,335 | B2 * | 7/2013 | Matsumoto | H01R 13/506 439/587 |
| 2008/0009171 | A1 * | 1/2008 | Tsuji | H01R 13/6272 439/352 |

* cited by examiner

CONNECTOR

CROSS REFERENCE TO RELATED APPLICATION

This application is based on Japanese Patent Application (No. 2015-182525) filed on Sep. 16, 2015, the contents of which are incorporated herein by reference. Also, all the references cited herein are incorporated as a whole.

BACKGROUND OF THE INVENTION

1. Technical Field

The present invention relates to a connector for housing a terminal in a terminal accommodating chamber of a connector housing.

2. Background Art

Hitherto, a connector is adapted to accommodate a terminal in a predetermined posture at a predetermined position of a terminal accommodating chamber of a connector housing.

Such a connector engages the terminal by an elastic engaging lance at a predetermined position of the terminal accommodating chamber (for example, see Patent Document 1).

Patent Document 1 is JP-A-2015-90830.

SUMMARY OF THE INVENTION

However, in a case where a connecting part between a terminal and a connection mating terminal has a cylindrical shape, since a wall surface in the terminal accommodating chamber has a circular shape corresponding to shape of the terminal, the terminal is likely to move in a rotating direction and become a shape that can be easily inserted into the terminal accommodating chamber by being unlikely to interference when the terminal is inserted to the inserting completion position of the terminal accommodating chamber. Moreover, the elastic engaging lance of which a main function is to prevent the terminal from being withdrawn from the terminal accommodating chamber is unlikely to suppress the rotation of the terminal.

The present invention has been made to solve the aforementioned problem and an object of the present invention is to provide a connector which can reliably prevent the rotation of the terminal in the terminal accommodating chamber, while easily inserting the terminal into the terminal accommodating chamber, even if connecting part between the terminal and the connection mating terminal has a cylindrical shape.

To solve the problem described above and to achieve the object, according to a first aspect of the present invention, there is provided a connector including: at least one terminal that has a cylindrical connecting section which constitutes a connecting part with a connection mating terminal, and a pair of uprise walls which connect between the connecting section and a crimping section to an electric wire so that bottom surfaces of the connecting section and the crimping section are continuous with each other and in which both edges of a bottom wall forming the bottom surface stand upright along a circular end surface of the connecting section; a connector housing that has at least one terminal accommodating chamber in which the terminal is accommodated; an engaging member that is mounted on the connector housing so as to be slidable between a temporary engaging position and a final engaging position in a direction perpendicular to an inserting direction of the terminal to the terminal accommodating chamber, and includes a terminal guide/engaging section which has circular arc-shaped curved surfaces formed along the direction perpendicular to the inserting direction adjacent to each other and an apex formed continuously with the circular arc-shaped curved surfaces between the adjacent circular arc-shaped curved surfaces, the circular arc-shaped curved surfaces being able to induce the terminal to an inserting completion position toward the terminal accommodating chamber when the engaging member is at the temporary engaging position, the terminal guide/engaging section engaging the terminal with the apex disposed on a position to project toward the bottom wall between the pair of uprise walls when the engaging member is at the final engaging position.

In addition, according to a second aspect of the present invention, in the invention described above, a plurality of terminal accommodating chambers may be formed along a sliding direction of the engaging member, and the terminal guide/engaging section may be formed so as to arrange a plurality of apexes along the sliding direction so that a plurality of terminals accommodated in the plurality of terminal accommodating chambers are engaged.

In addition, according to a third aspect of the present invention, in the invention described above, the engaging member may have a terminal posture correction portion on which a terminal posture correction contact surface is formed to rotate the terminal so that the apex is in an engaging position to project toward the bottom wall between the pair of uprise walls in the final engaging position, by being in contact with the bottom surface of the crimping section of the terminal which is inclined relative to a normal posture in a rotating direction in which a straight line extending in the inserting direction as the rotating axis by sliding from the temporary engaging position to the final engaging position.

The connector according to the first aspect of the present invention serves a guide function in which the circular arc-shaped curved surface of the engaging member induces the terminal to an inserting completion position, when the terminal is inserted in the terminal accommodating chamber, in a state where the engaging member is positioned in the temporary engaging position, and when the engaging member is slid from the temporary engaging position to the final engaging position, the apex of the engaging member is disposed on the position projecting toward the bottom wall between the a pair of uprise walls. In a case where an external force is applied to the terminal in the rotating direction of which the rotating axis is a straight line extending in the inserting direction, and thus the terminal is rotated, the rotation is suppressed by the end edge surface of each uprise wall of the plurality of uprise walls being in contact with the circular arc-shaped curved surface. Therefore, even if the connecting part with the connection mating terminal is a terminal having a cylinder shape, it is possible to reliably suppress the rotation of the terminal in the terminal accommodating chamber while easily inserting the terminal to the terminal accommodating chamber.

The connector according to the second aspect of the present invention is capable of inducing the plurality of terminals accommodated in the plurality of terminal accommodating chambers arranged in the sliding direction up to the inserting completion position in the temporary engaging position and is capable of engaging the plurality of terminals together at the final engaging position, since the engaging member is formed to arrange the plurality of apexes along the sliding direction so that the engaging member engages the plurality of terminals accommodated in the plurality of terminal accommodating chambers.

The connector according to the third aspect of the present invention is capable of inserting the terminal up to the inserting completion position of the terminal accommodating chamber without worrying about the posture in the rotating direction of the terminal and, as a result, is capable of easily performing an operation of inserting the terminal to the terminal accommodating chamber, when the engaging member is slid from the temporary engaging position to the final engaging position, since the posture of the terminal can be corrected to the normal posture at the rotating direction of which the rotating axis is a straight line extending in the inserting direction by the terminal posture correction portion.

DETAILED DESCRIPTION OF THE EXEMPLARY EMBODIMENTS

Hereinafter, preferred examples of the connector according to the invention will be described in detail with reference to the drawings.

Example 1

Figure 1:
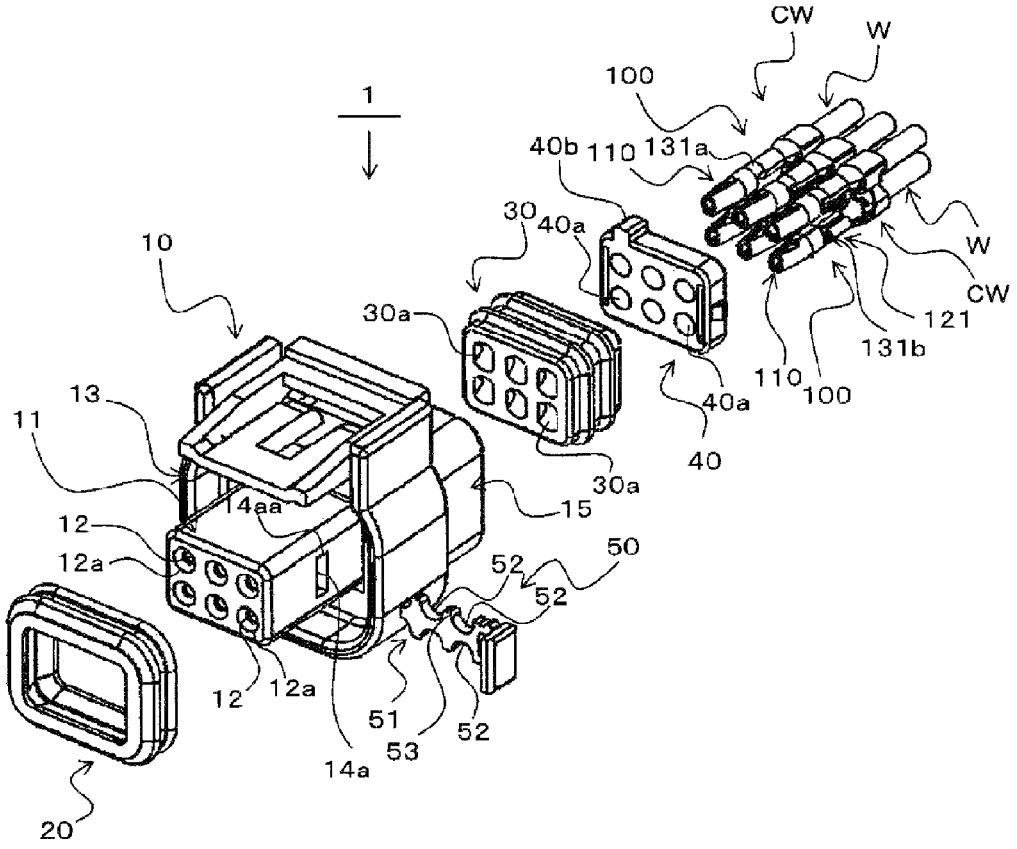
FIG. 1 is an exploded perspective view of a connector according to Example 1 of the present invention.
Figure 2:
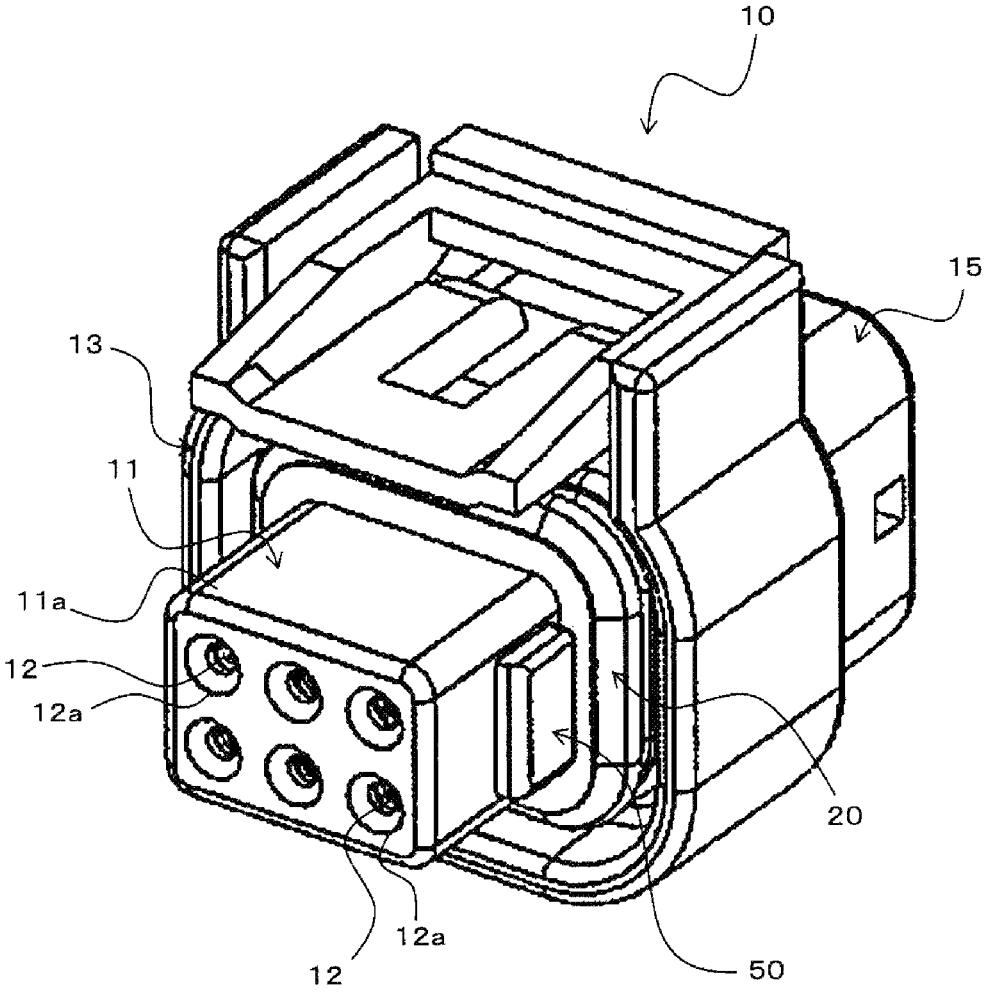
FIG. 2 is a perspective view of the connector.
Figure 3:
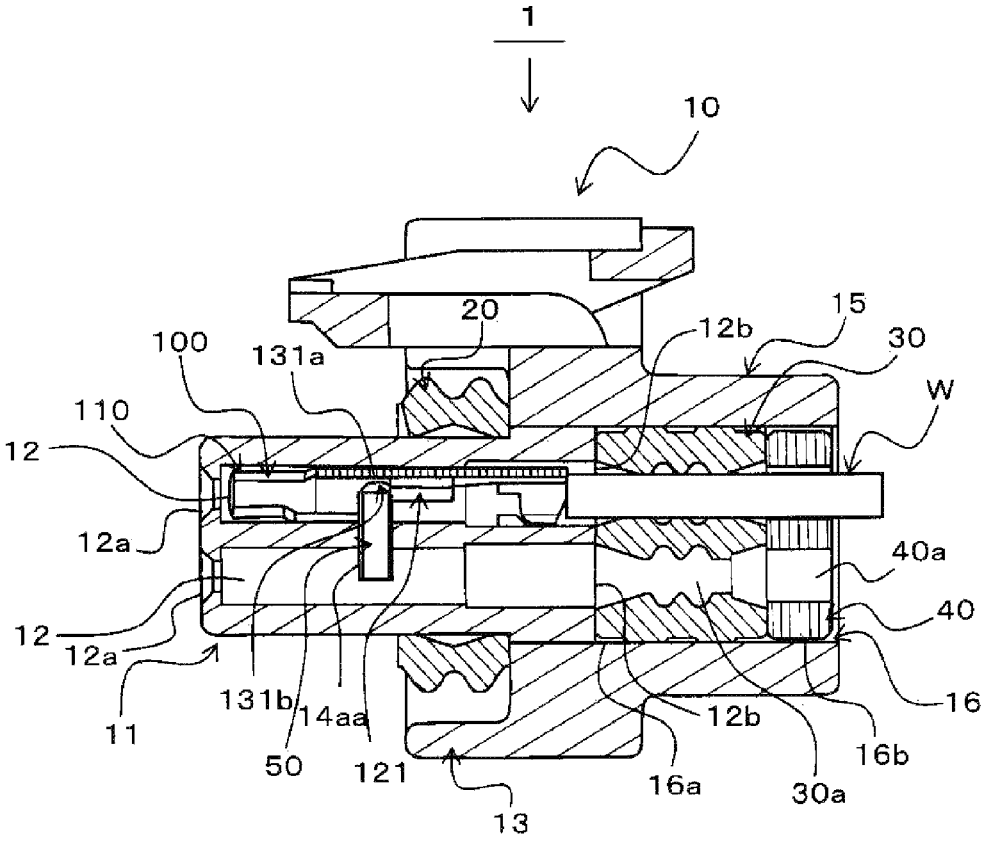
FIG. 3 is a cross-sectional view of the connector illustrating a state where a terminal is accommodated in a terminal accommodating chamber which is positioned in the upper of FIG. 3.
Figure 4:
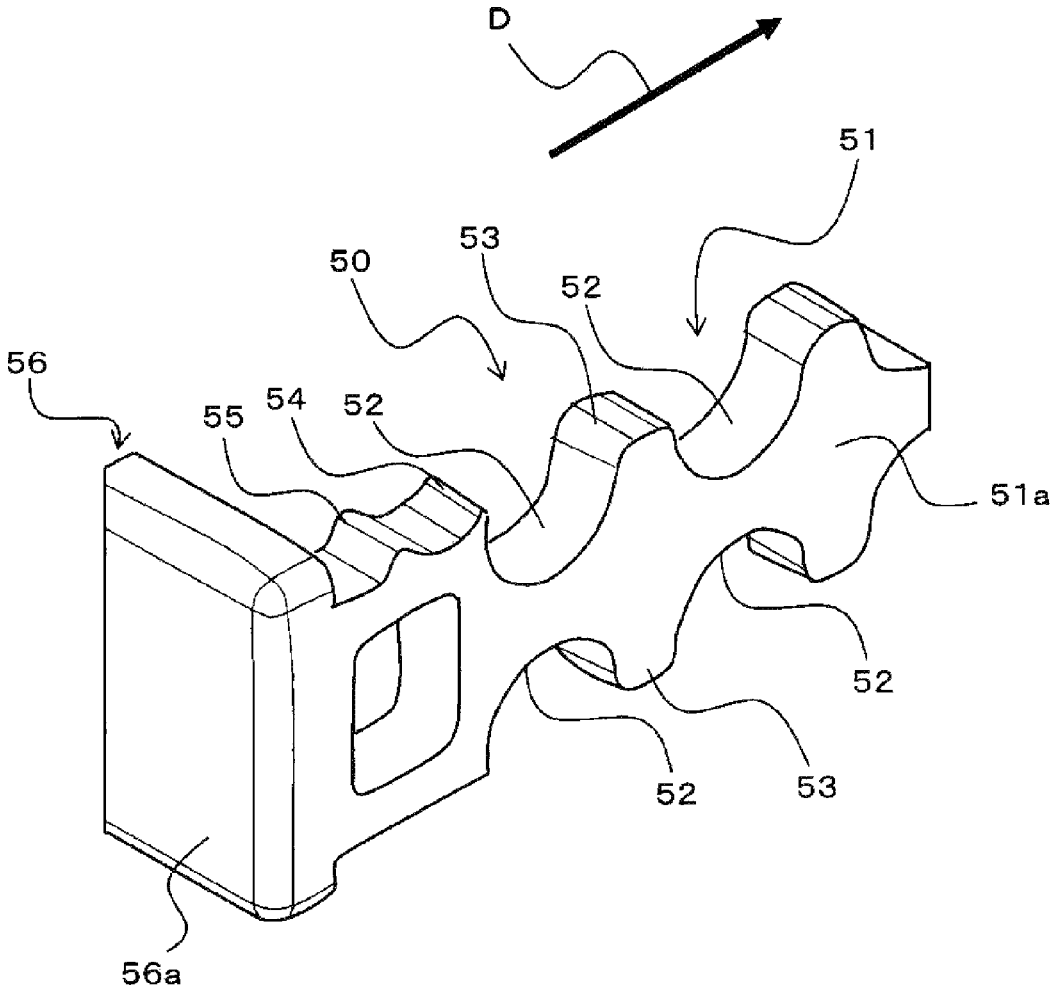
FIG. 4 is a perspective view of an engaging member.
Figure 5:
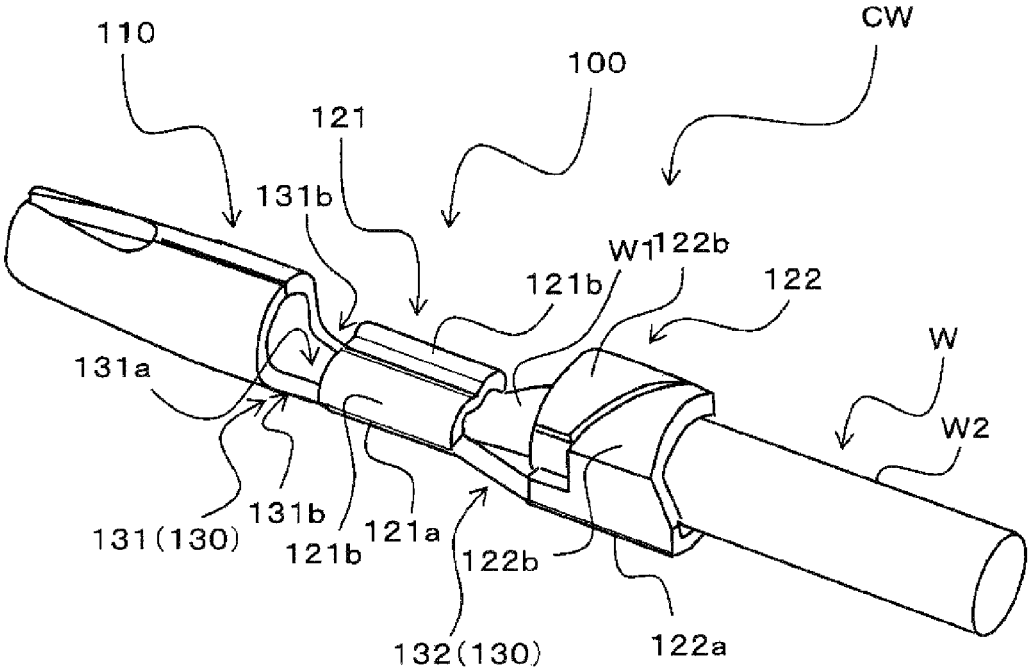
FIG. 5 is a perspective view of a terminal attached wire.
Figure 6A:
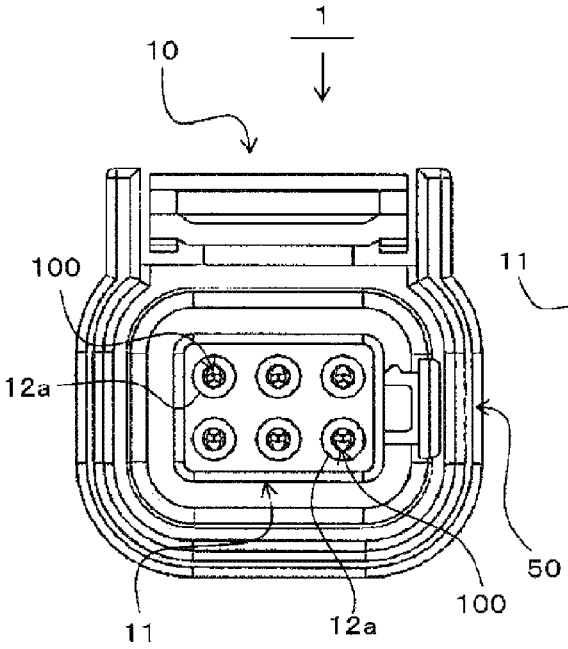
FIG. 6A is a front view illustrating the connector viewed from a fitting side front surface of the connection mating connector.
Figure 6B:
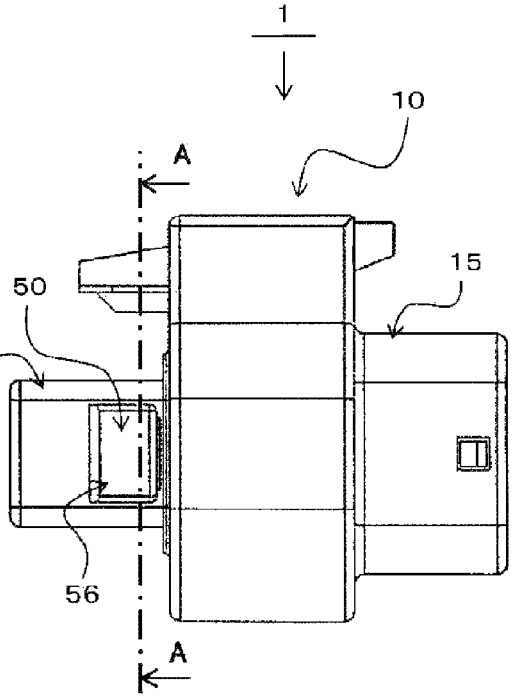
FIG. 6B is a side view illustrating the connector viewed from an engaging member inserting slot side, in a state where the engaging member is positioned in a temporary engaging position.
Figure 7A:
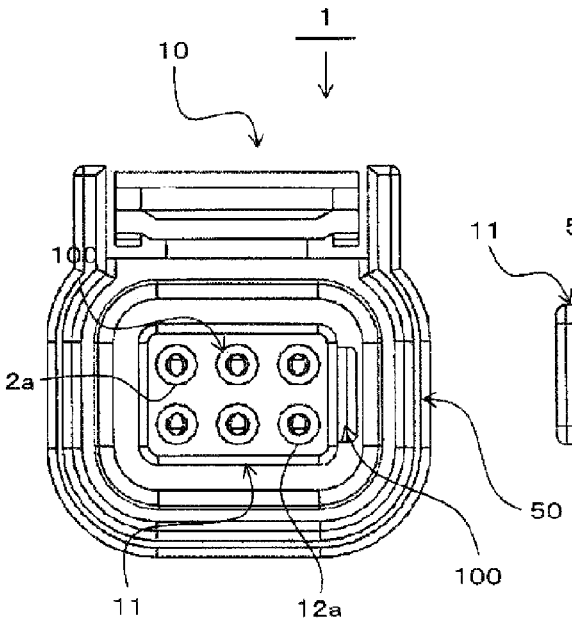
FIG. 7A is a front view illustrating the connector viewed from the fitting side front surface of the connection mating connector.
Figure 7B:
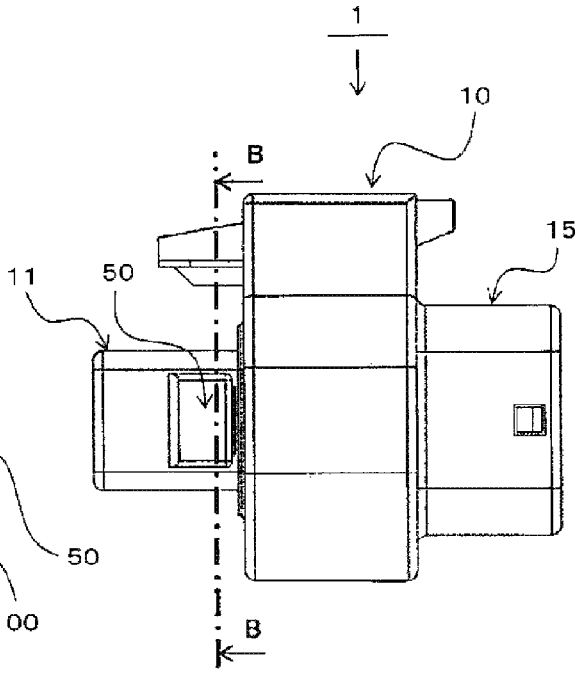
FIG. 7B is a side view illustrating the connector viewed from the engaging member inserting slot side, in a state where the engaging member is positioned in the final engaging position.
Figure 8A:
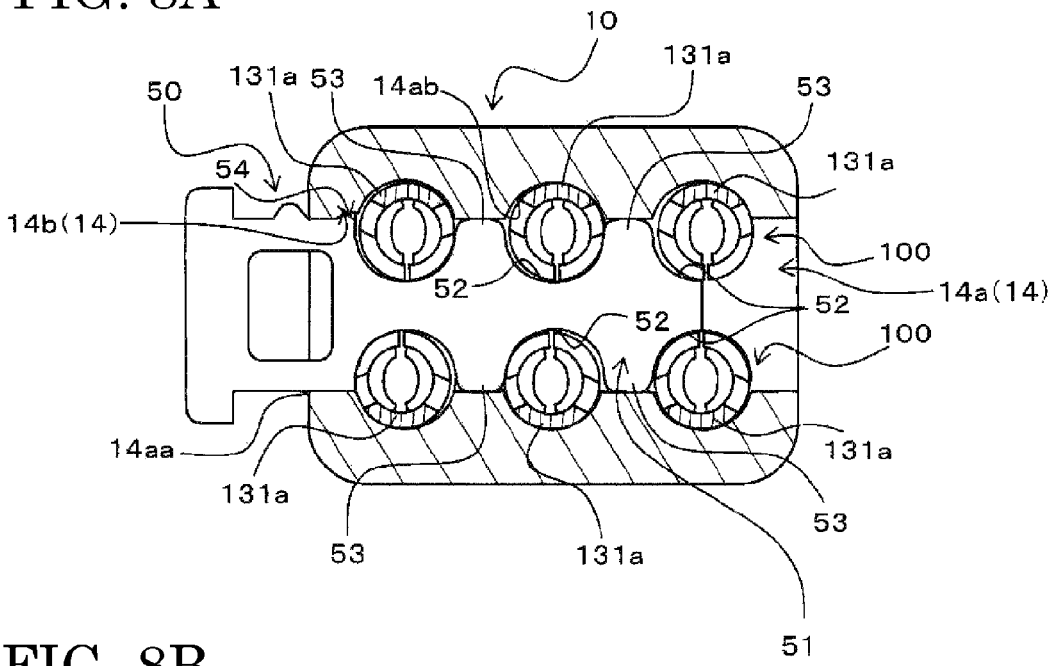
FIG. 8A is a line A-A cross-sectional view of the connector illustrated in FIG. 6B.
Figure 8B:
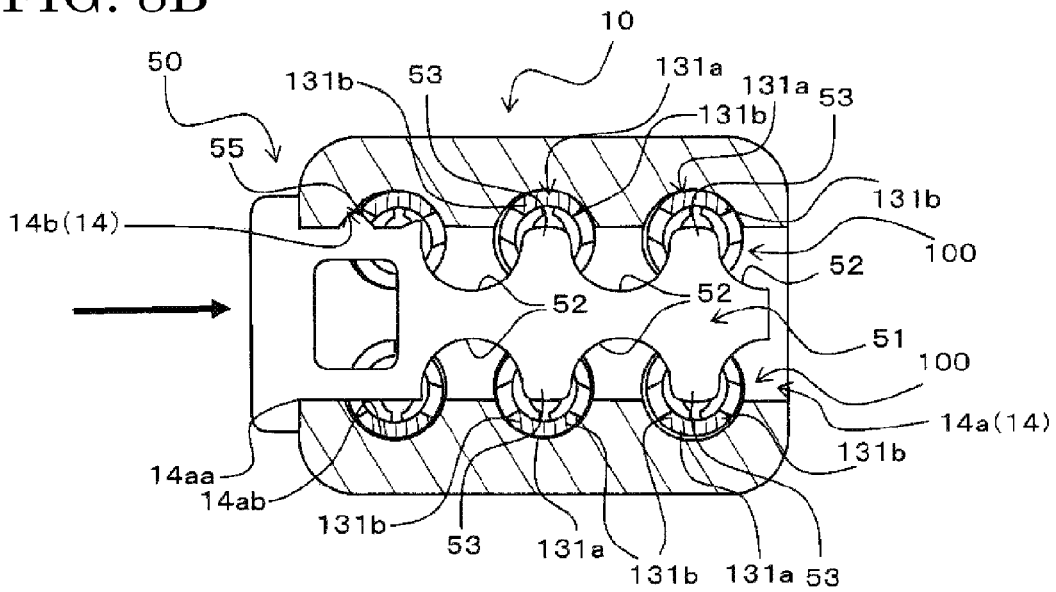
FIG. 8B is a line B-B cross-sectional view of the connector illustrated in FIG. 7B.
Figure 9A:
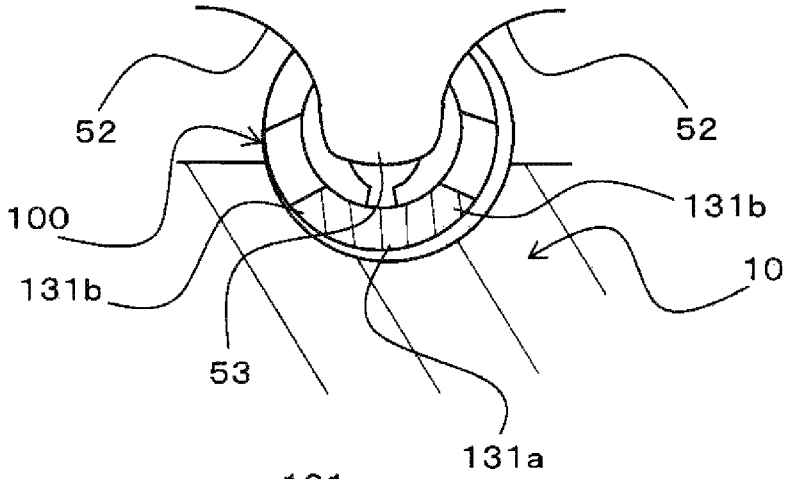
FIGS. 9A to 9C are views for illustrating a state where the rotating of the terminal in the terminal accommodating chamber is restrained by the engaging member.
Figure 9B:
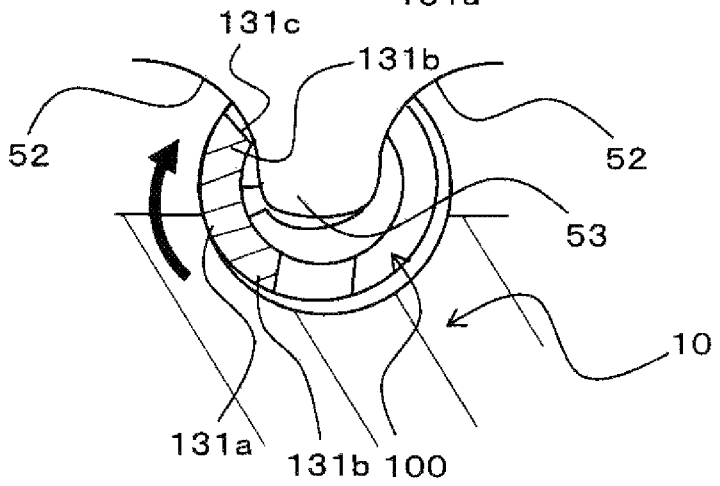
Figure 9C:
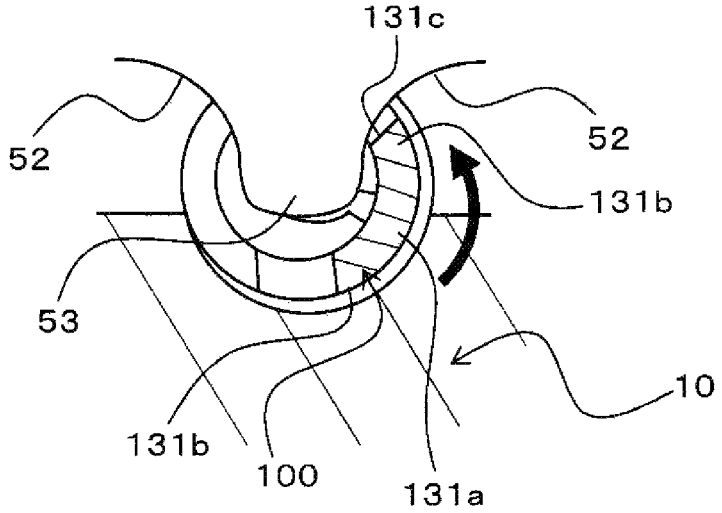

FIG. 1 is an exploded perspective view of a connector 1 according to Example 1 of the present invention. FIG. 2 is a perspective view of the connector 1. FIG. 3 is a cross-sectional view of the connector 1 illustrating a state where a terminal 100 is accommodated in a terminal accommodating chamber 12 which is positioned in the upper of FIG. 3. FIG. 4 is a perspective view of an engaging member 50. FIG. 5 is a perspective view of a terminal attached wire CW. FIG. 6A is a front view illustrating the connector 1 viewed from a fitting side front surface of the connection mating connector and FIG. 6B is a side view illustrating the connector 1 viewed from an engaging member inserting slot 14*aa* side, in a state where the engaging member 50 is positioned in the temporary engaging position. FIG. 7A is a front view illustrating the connector 1 viewed from the fitting side front surface of the connection mating connector and FIG. 7B is a side view illustrating the connector 1 viewed from the engaging member inserting slot 14*aa* side, in a state where the engaging member 50 is positioned in the final engaging position. FIG. 8A is a line A-A cross-sectional view of the connector 1 illustrated in FIG. 6B, and FIG. 8B is a view illustrating a line B-B cross-sectional view of the connector 1 illustrated in FIG. 7B. FIGS. 9A to 9C are views for illustrating a state where the rotating of the terminal 100 in the terminal accommodating chamber 12 is restrained by the engaging member 50.

The connector 1 according to the example of the present invention is a connector used in a camera, for example and accommodates the terminal 100 in a terminal accommodating chamber 12 of a connector housing 10. The terminal 100 includes a cylindrical connecting section 110 which constitutes a connecting part with connection mating terminal and a pair of uprise walls 131*b* and 131*b* which connects between the connecting section 110 and a crimping section 121 to an electric wire W so that bottom surfaces of the connecting section 110 and the crimping section 121 are continuous with each other and in which both edges of the bottom wall 131*a* forming the bottom surface stand upright along a circular end surface of the connecting section 110.

The connector 1 includes a plurality of terminal attached electric wires CW in which the terminal 100 accommodated in the terminal accommodating chamber 12 is attached to a distal end portion of the electric wire W, the connector housing 10, an engaging member 50 which engages the terminal 100 within the terminal accommodating chamber 12, a fitting side seal member 20 which seals in a liquid-tight manner a fitting portion of the connection mating connector (not illustrated) of the connector housing 10, an electric wire pull-out side seal member 30 which seals in a liquid-tight manner an electric wire pull-out outlet side of the terminal attached electric wire CW of connector housing 10, and a cover member 40 which closes an attaching port of the electric wire pull-out side seal member 30 while fixing the electric wire pull-out side seal member 30 to the connector housing 10.

First, the terminal attached electric wire CW will be described.

As illustrated in FIG. 5, the terminal attached electric wire CW fixes the terminal 100 to the distal end portion of the electric wire W by a crimping section 120.

The terminal 100 is formed by a bending process of metal material, or the like, and includes the connecting section 110, the crimping section 120, and a coupling section 130.

The connecting section 110 forms a tip end portion of the terminal 100 and is connected to the connection mating terminal (not illustrated) by the connecting section of the connection mating terminal being inserted in the cylinder.

The crimping section 120 includes a core wire crimping section 121 for crimping a core wire portion W1 exposed by peeling a skin of an insulating coating W2 of the distal end portion of the electric wire W and a covering crimping section 122 for crimping a part where the skin of the insulating coating W2 of the electric wire W is not peeled.

The core wire crimping section 121 includes a bottom wall 121*a* which is continuous with the bottom wall 131*a* of the first coupling section 131, which will be described later and is a part which is fixed to the core wire portion W1 of the electric wire W by combining end surfaces of a pair of crimping pieces 121*b* and 121*b* provided to the both edges of the bottom wall 121*a* at a substantially center position and then crimping.

The covering crimping section 122 includes a bottom wall 122*a* which is continuous with the bottom wall 121*a* of the core wire crimping section 121, and is a part which is fixed to the electric wire W by crimping the pair of crimping pieces 122*b* and 122*b* provided to the both edges of the bottom wall 122*a* to a part where the skin of the insulating coating W2 of the electric wire W is not peeled.

The coupling section 130 includes a first coupling section 131 which couples between the connecting section 110 and the core wire crimping section 121 with each other and a second coupling section 132 which couples between the core wire crimping section 121 and the covering crimping section 122 with each other.

The first coupling section 131 couples between the connecting section 110 and the core wire crimping section 121 so that the bottom surfaces of the connecting section 110 and the core wire crimping section 121 are continuous with each other, and includes a bottom wall 131*a* forming a bottom surface and a pair of uprise walls 131*b* and 131*b* in which both edges of the bottom wall 131*a* stand upright along the circular end surface of the connecting section 110.

The pair of uprise walls 131*b* and 131*b* stands upright by bending from the bottom wall 131*a* in a circular arc shape. Therefore, when an apex 53 (to be described below) of the engaging member 50 is disposed between the pair of uprise walls 131*b* and 131*b*, in a case where the terminal 100 is rotated in the terminal accommodating chamber 12, the end edge surface 131*c* of the uprise wall 131*b* is likely to be in contact with the circular arc-shaped curved surface 52 (to be described below) of the engaging member 50.

The second coupling section 132 is coupled between the core wire crimping section 121 and the covering crimping section 122 with each other so that the bottom surfaces of the core wire crimping section 121 and the covering crimping section 122 are continuous with each other.

Next, the connector housing 10 will be described.

The connector housing 10 is made of insulating synthetic resin material, and includes a terminal accommodating portion 11 in which a plurality of terminal accommodating chambers 12 are formed, a hood portion 13 which is formed in the hood shape so as to surround a portion of the outer periphery of the terminal accommodating portion 11, a seal member holding housing portion 16*a* which holds and thus houses an electric wire pull-out side seal member 30, and a cover member holding housing portion 16*b* which holds and thus houses the cover member 40.

The terminal accommodating portion 11 includes a block-shaped main body 11*a* which is projected in a block shape toward the fitting direction of the connection mating connector and the plurality of terminal accommodating chambers 12 are formed by passing through the block-shaped main body 11*a* in a fitting direction.

The terminal accommodating chamber 12 forms a substantially circular-shaped inner wall surface corresponding to an outer shape of the connecting section 110 of the terminal 100 to extend in the inserting direction of the terminal 100.

The terminal accommodating chamber 12 includes a connection mating terminal inserting slot 12*a* in which the connecting mating terminal is inserted and is an opening positioned in the fitting side end surface of the block-shaped main body 11*a* for the connection mating connector and a terminal inserting slot 12*b* in which the terminal 100 is inserted and is an opening positioned in the opposite side end surface of the block-shaped main body 11*a*.

In the example, the connector housing 10 includes three terminal accommodating chambers 12 which are arranged in the sliding direction of the engaging member 50 and are provided side by side in two rows, in the block-shaped main body 11*a*. In other words, the connector housing 10 includes six terminal accommodating chambers 12 in the block-shaped main body 11*a*.

In addition, the terminal accommodating portion 11 includes an engaging member slide attaching portion 14 in which the engaging member 50 is mounted on the direction perpendicular to the inserting direction of the terminal 100 to the terminal accommodating chamber 12 to be capable of sliding between a temporary engaging position and a final engaging position.

The engaging member slide attaching portion 14 includes an engaging member inserting space 14*a* which is formed on the block-shaped main body 11*a* to be capable of inserting the engaging member 50 while sliding the engaging member 50 in the direction perpendicular to the inserting direction of the terminal 100 and a positioning engaging portion 14*b* which engages the engaging member 50 at the temporary engaging position and at the final engaging position in the sliding direction within the engaging member inserting space 14*a* by engaging to each of a temporary engaging projection 54 (to be described below) and a final engaging projection 55 (to be described below) of the engaging member 50.

The engaging member inserting space 14*a* includes an engaging member inserting slot 14*aa* on the one side surface of the block-shaped main body 11*a* which corresponds to a cross-sectional shape perpendicular to the sliding direction of the engaging member 50, and forms to traverse a plurality of terminal accommodating chambers 12 from the engaging member inserting slot 14*aa*. Accordingly, the engaging member inserting space 14*a* is a space which passes through the block-shaped main body 11*a* in the direction perpendicular to the inserting direction of terminal 100.

The wall surface forming the engaging member inserting space 14*a* has a circular arc-shaped curved surface 14*ab* (see FIGS. 8A and 8B) in which the part corresponding to each terminal accommodating chamber 12 corresponds to the shape of an inner wall surface of the terminal accommodating chamber 12.

The positioning engaging portion 14*b* is a part having a concave shape in which the temporary engaging projection 54 and the final engaging projection 55 of the engaging member 50 are capable of fitting each other. When the engaging member 50 is inserted in the engaging member inserting slot 14*aa* and then slides into the engaging member inserting space 14*a*, the positioning engaging portion 14*b* engages the engaging member 50 in the temporary engaging position by the temporary engaging projection 54 of the engaging member 50 being engaged.

In addition, when the engaging member 50 is further slid from the temporary engaging position to the inside of the engaging member inserting space 14*a*, the positioning engaging portion 14*b* engages the engaging member 50 in the final engaging position by the final engaging projection 55 of the engaging member 50 being engaged.

The hood portion 13 is a part which overlays along the outer peripheral surface of fitting side end portion of the connection mating connector and then fits and may be mounted in a hood by an annular fitting side seal member 20 passing through up to the proximal end position of the block-shaped main body 11*a*.

Therefore, the fitting portion of the connection mating connector and the connector 1 can be sealed in a liquid-tight manner by the hood portion 13 and the fitting side seal member 20.

The seal member holding housing portion 16*a* is formed by a peripheral wall 15 which is formed on the connector housing 10 in order to head from the end surface of the electric wire pull-out side of the terminal accommodating portion 11 to the opening in the electric wire pull-out direction. In other words, the seal member holding housing portion 16*a* holds the electric wire pull-out side seal member 30 on the predetermined position by the electric wire pull-out side seal member 30 being housed in the housing space formed by the peripheral wall 15.

The electric wire pull-out side seal member 30 is adjusted in the slightly larger outer dimension than the outer dimension of the inner peripheral surface of the peripheral wall 15. In addition, the electric wire pull-out side seal member 30 includes an electric wire inserting hole 30*a* in order to insert the terminal attached electric wire CW toward each terminal accommodating chamber 12 in a liquid tight manner.

The electric wire pull-out side seal member 30 seals the opening of the peripheral wall 15 in a liquid tight manner by being pushed up to the end surface of the electric wire pull-out side of the terminal accommodating portion 11 in the peripheral wall 15 while being compressed using elasticity.

The cover member holding housing portion 16*b* holds and houses a cover member 40 using the housing space which is positioned closer to the opening than the housing position of the electric wire pull-out side seal member 30 among the housing space formed by the peripheral wall 15.

The cover member 40 is adjusted in the slightly smaller outer dimension than the outer dimension of the inner peripheral surface of the peripheral wall 15. In addition, the cover member 40 includes an electric wire inserting hole 40*a* for inserting each terminal attached electric wire CW from the opening of the peripheral wall 15 toward the electric wire pull-out side seal member 30.

In addition, the cover member 40 includes an engaging projection 40*b* which engages to the engaging portion (not illustrated) provided on the peripheral wall 15, in order to fix in the housing space 16 formed by the peripheral wall 15.

Therefore, the cover member 40 is capable of being held in the housing space 16 in a state where the electric wire pull-out side seal member 30 is compressed toward the end surface of the electric wire pull-out side of the terminal accommodating portion 11.

Next, the engaging member 50 will be described.

The engaging member 50 is mounted on the connector housing 10 so as to be slidable between the temporary engaging position and the final engaging position in a direction perpendicular to the inserting direction of the terminal 100 to the terminal accommodating chamber 12, and includes a terminal guide/engaging section 51 which engages the terminal 100 in a manner that the circular arc-shaped curved surfaces 52 which are able to induce the terminal 100 from the temporary engaging position to an inserting completion position toward the terminal accommodating chamber 12 are formed along the direction perpendicular to the inserting direction and continue so as to form an apex 53 between the adjacent circular arc-shaped curved surfaces 52, and at the final engaging position, the apex 53 is disposed on the position to project toward the bottom wall 131*a* between the pair of uprise walls 131*b* and 131*b*.

The engaging member 50 is made of insulating synthetic resin material and as illustrated in FIG. 4, includes the terminal guide/engaging section 51, the temporary engaging projection 54 and a final engaging projection 55 which engage to position the engaging member 50 at the temporary engaging position and the final engaging position in the sliding direction D by engaging to the positioning engaging portion 14*b*, and an operating portion 56 for operating to move the engaging member 50 in the sliding direction D by an operator.

The terminal guide/engaging section 51 is provided to be aligned along the sliding direction into a plate-like slide main body 51*a* and to have a line symmetrical shape in a straight line along the sliding direction.

In this example, four apexes 53 are provided in the terminal guide/engaging section 51. The number of the apexes is not equal to the number of the six terminals 100 accommodated in six terminal accommodating chambers 12. However, the six apexes 53 may be provided to correspond to all the terminals 100.

The temporary engaging projection 54 and the final engaging projection 55 are provided to project into an end edge surface of the proximal end side of the slide main body 51*a*.

The operating portion 56 includes a plate-shape operating main body portion 56*a* coupled to be perpendicular to the sliding direction of the engaging member 50 with respect to the slide main body 51*a*.

The operator is capable of sliding the engaging member 50 from the temporary engaging position to the final engaging position by pressing the outer surface of the operating main body portion 56*a*.

In addition, the operator is capable of sliding the engaging member 50 from the final engaging position to the temporary engaging position by pulling the operating main body portion 56*a*.

Next, a procedure in which the terminal 100 is engaged in the terminal accommodating chamber 12 by the engaging member 50 after the terminal 100 is accommodated in the terminal accommodating chamber 12 will be described.

The connector housing 10 is in a state where attachment of the engaging member 50, the fitting side seal member 20, the electric wire pull-out side seal member 30, and the cover member 40 to the connector housing 10 is completed. In addition, the engaging member 50 is disposed on the temporary engaging position (see FIGS. 6A and 6B).

First, the operator inserts the terminals 100 of each terminal attached electric wire CW from the electric wire inserting hole 40*a* of the cover member 40 and then pushes up to the inserting completion position in the terminal accommodating chamber 12.

At this time, since the engaging member 50 is in the temporary engaging position, the engaging member 50 generally forms a circular inner wall surface by each circular arc-shaped curved surface 52 of the engaging member 50 being fitted together into the circular arc-shaped curved surface 14*ab* of the engaging member inserting space 14*a*. Therefore, the terminal 100 is capable of smoothly moving up to an inserting completion position of the terminal accommodating chamber 12 without rattling in the engaging member inserting space 14*a*. In other words, each circular arc-shaped curved surface 52 of the engaging member 50 serves a guide function to induce the terminal 100 in the inserting direction (see FIG. 8A).

The operator allows each terminal 100 to be engaged in the terminal accommodating chamber 12 by sliding the engaging member 50 to the final engaging position, after the terminal 100 is accommodated in the entirety of the terminal accommodating chamber 12 (see FIGS. 7A and 7B).

Accordingly, each apex 53 of the engaging member 50 is disposed on the position at which the apex 53 projects toward the bottom wall 131*a* between the pair of uprise walls 131*b* and 131*b* of the terminal 100 accommodated in the terminal accommodating chamber 12 (see FIG. 8B).

At this state, in a case where an external force applies to the terminal 100 for withdrawing outside of the terminal accommodating chamber 12, the connecting section 110 of the terminal 100 is in contact with the apex 53 and thus the terminal 100 is not withdrawn outside of the terminal accommodating chamber 12.

In addition, as illustrated in FIGS. 9A to 9C, in a case where the terminal 100 is rotated in the rotating direction of which the rotating axis is a straight line extending in the inserting direction, the rotation of the terminal 100 is prevented by the end edge surface 131*c* of each uprise wall 131*b* of the pair of uprise walls 131*b* and 131*b* being in contact with the circular arc-shaped curved surface 52.

Here, in a case where the terminal 100 is rotated, the end edge surface 131*c* of the uprise wall 131*b* by bending from the bottom wall 131*a* in a circular arc shape and the circular arc-shaped curved surface 52 of the engaging member 50 are in contact with each other. In other words, since the end edge surface 131*c* of the uprise wall 131*b* and the circular arc-shaped curved surface 52 toward the direction in which both surfaces thereof are easily in contact with each other, the rotation of the terminal 100 is reliably prevented by the circular arc-shaped curved surface 52.

In addition, when the engaging member 50 is slid from the temporary engaging position to the final engaging position, the plurality of terminals 100 are engaged in each terminal accommodating chamber 12.

The connector 1 according to Example 1 of the present invention serves a guide function that the circular arc-shaped curved surface 52 of the engaging member 50 induces the terminal 100 up to an inserting completion position, when the terminal 100 is inserted in the terminal accommodating chamber 12, in a state where the engaging member 50 is positioned in the temporary engaging position, and when the engaging member 50 is slid from the temporary engaging position to final engaging position, since the apex 53 of the engaging member 50 is disposed on the position projecting toward the bottom wall 131*a* between the a pair of uprise walls 131*b* and 131*b*, in a case where the terminal 100 is rotated by the external force applying to the terminal 100 in the rotating direction of which the rotating axis is a straight line extending in the inserting direction of the terminal 100, since the rotation is suppressed by the end edge surface 131*c* of each uprise wall 131*b* of the pair of uprise walls 131*b* and 131*b* being in contact with the circular arc-shaped curved surface 52, even if the connecting part with the connection mating terminal is the terminal 100 having a cylinder shape, the rotation of the terminal 100 in the terminal accommodating chamber 12 may be reliably suppressed while easily inserted into the terminal accommodating chamber 12.

In addition, the connector 1 according to Example 1 of the present invention is capable of inducing the plurality of terminals 100 accommodated in the plurality of terminal accommodating chambers 12 arranged in the sliding direction up to the inserting completion position at the temporary engaging position and is capable of engaging together the terminal 100 at the final engaging position, since the engaging member 50 is formed to arrange the plurality of apexes 53 along the sliding direction so that the engaging member 50 engages the plurality of terminals 100 accommodated in the plurality of terminal accommodating chambers 12.

Example 2

Next, using FIG. 10 to FIG. 14C, a connector according to Example 2 of the present invention will be described.

Figure 10:
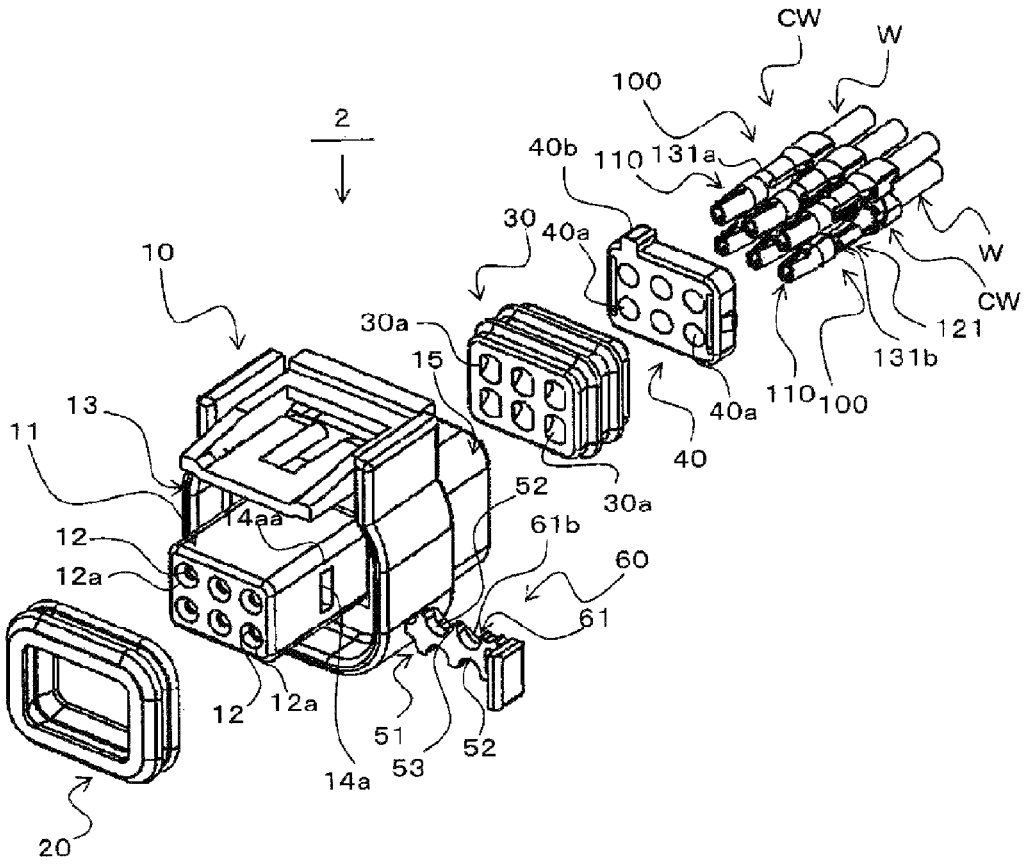
FIG. 10 is an exploded perspective view of connector according to Example 2 of the present invention.
Figure 11:
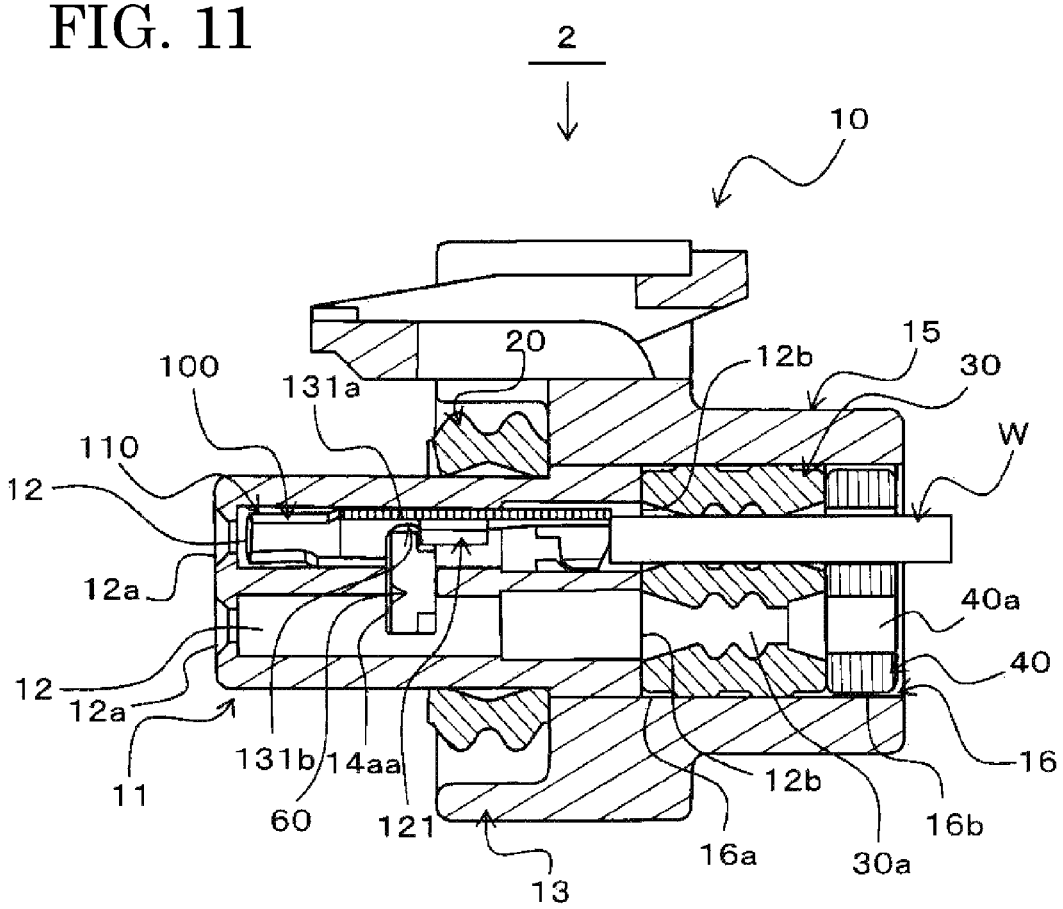
FIG. 11 is a cross-sectional view of the connector illustrating a state where a terminal is accommodated in a terminal accommodating chamber which is positioned in the upper of FIG. 11.
Figure 12:
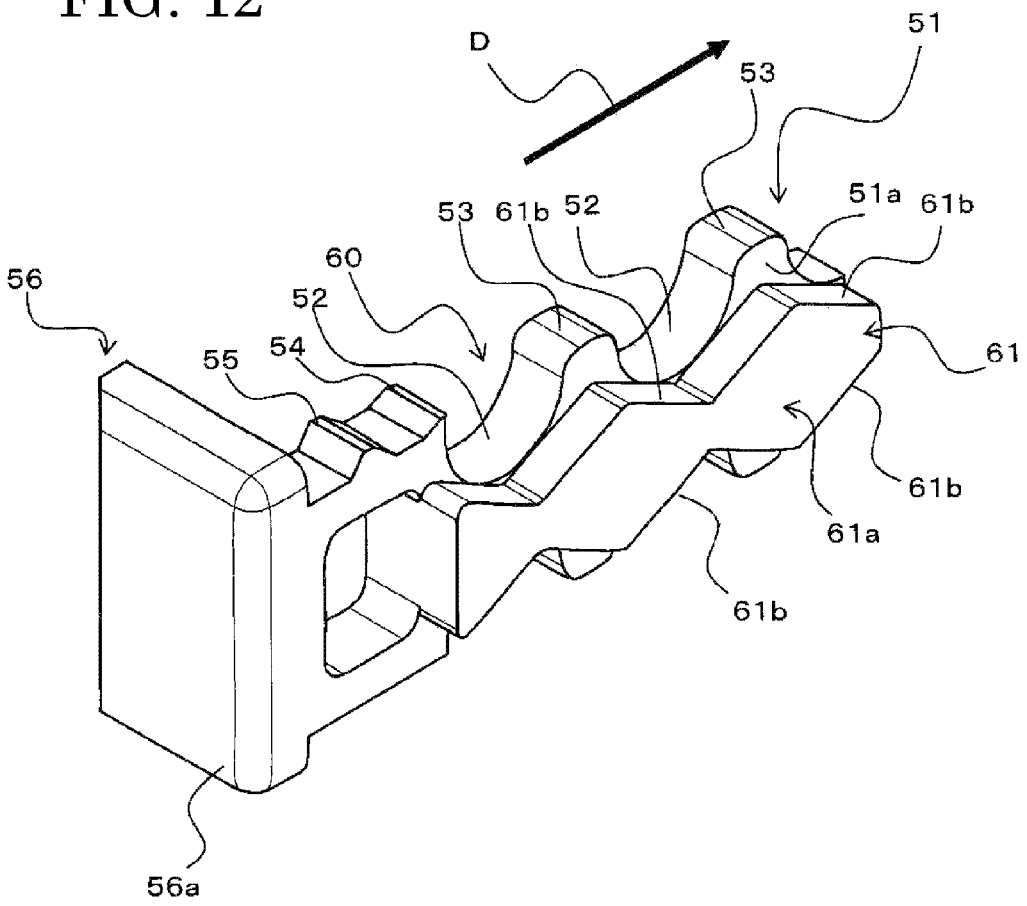
FIG. 12 is a perspective view of an engaging member illustrated in FIG. 1.
Figure 13A:
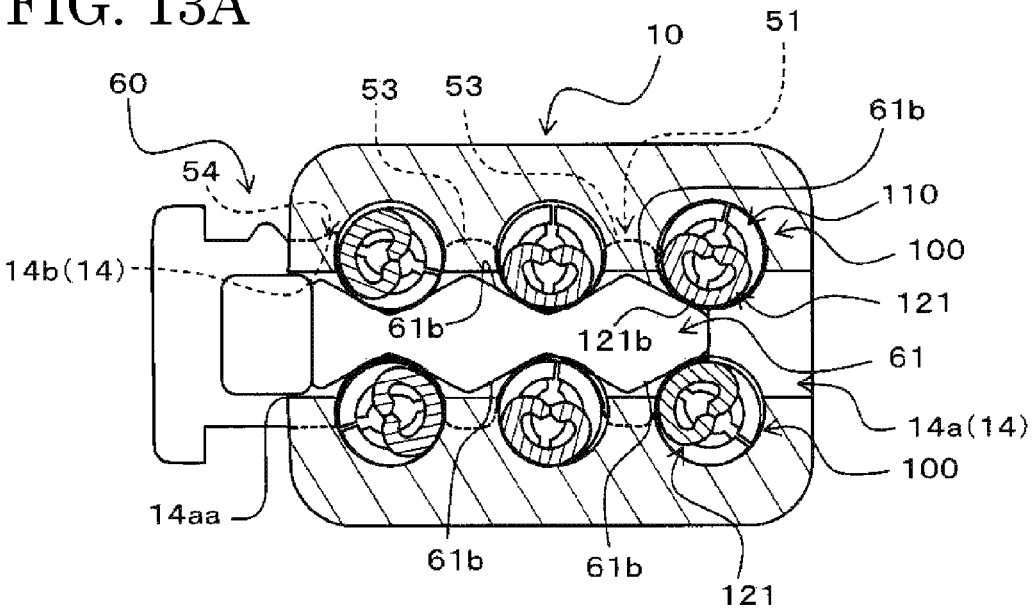
FIG. 13A is a cross-sectional view illustrating a connector in which the engaging member is positioned in the temporary engaging position.
Figure 13B:
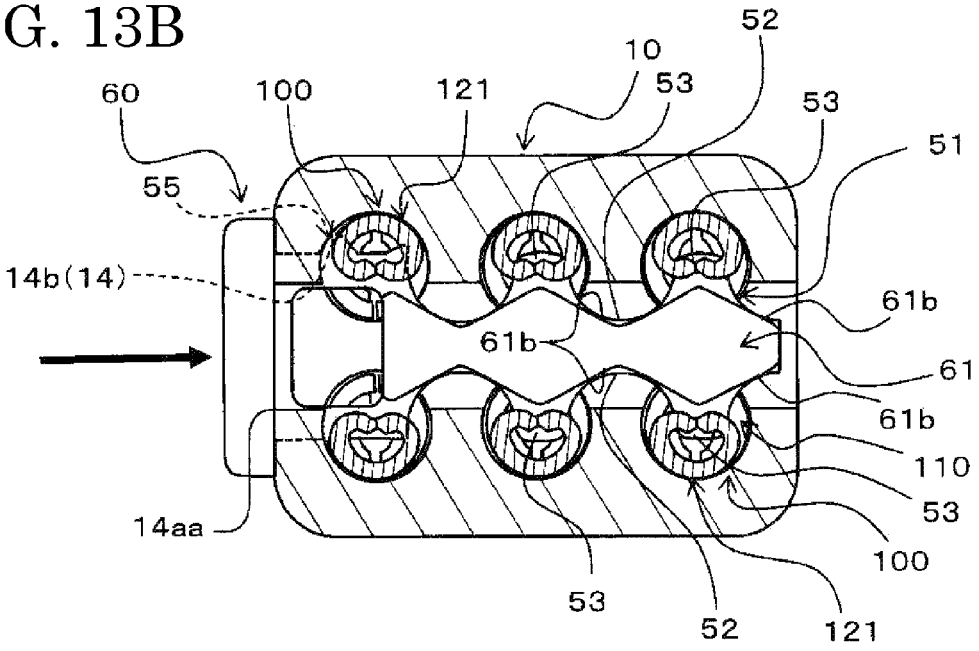
FIG. 13B is a cross-sectional view illustrating a connector in which the engaging member is positioned in the final engaging position.
Figure 14A:
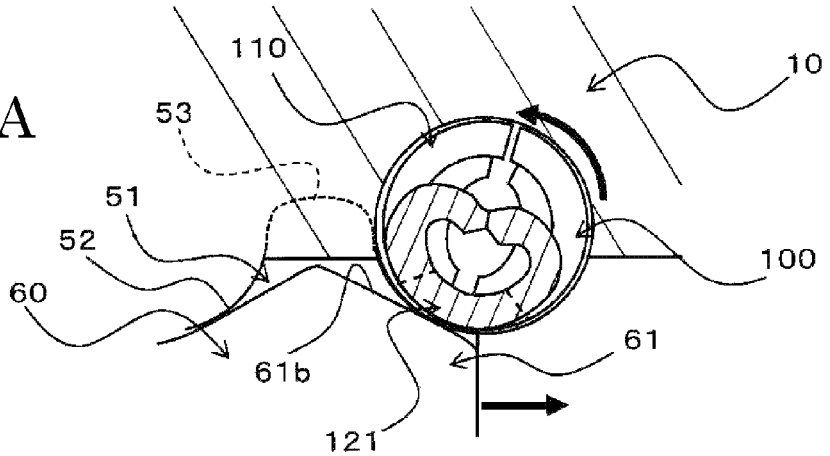
FIGS. 14A to 14C are views for illustrating a state where the posture of the terminal is corrected to a normal posture in the terminal accommodating chamber by the engaging member.
Figure 14B:
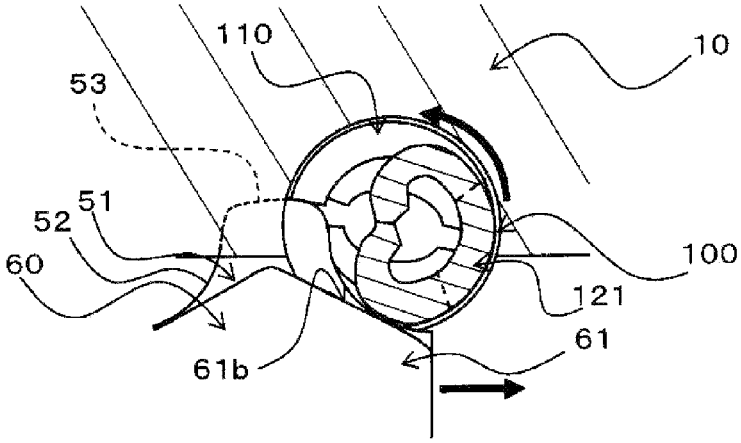
Figure 14C:
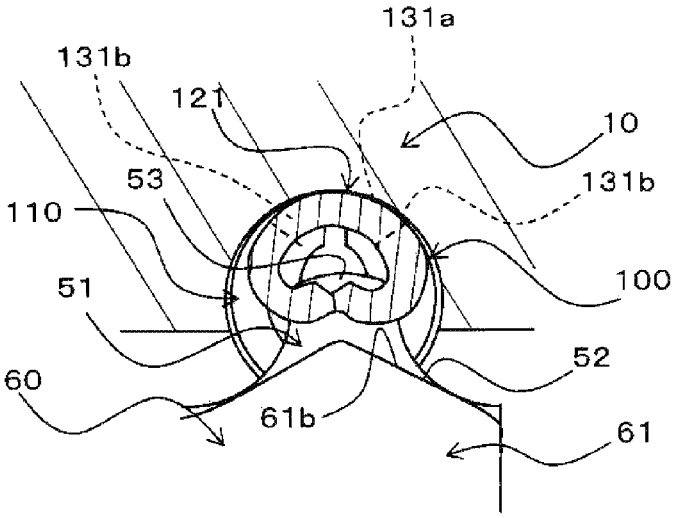

FIG. 10 is an exploded perspective view of a connector 2 according to Example 2 of the present invention. FIG. 11 is a cross-sectional view of the connector 2 illustrating a state where the terminal 100 is accommodated in the terminal accommodating chamber 12 which is positioned in the upper of FIG. 11. FIG. 12 is a perspective view of an engaging member 60 illustrated in FIG. 1. FIG. 13A is a cross-sectional view illustrating the connector 2 in which the engaging member 60 is positioned in the temporary engaging position, and FIG. 13B is a cross-sectional view illustrating the connector 2 in which the engaging member 60 is positioned in the final engaging position. FIGS. 14A to 14C are views for illustrating a state where the posture of the terminal 100 is corrected to a normal posture in the terminal accommodating chamber 12 by the engaging member 60.

The connector 2 of Example 2 is different from the connector 1 of Example 1 in that the engaging member 60 has a function of engaging the terminal 100 in the terminal accommodating chamber 12 as well as a function of correcting the terminal 100 in a normal engaging posture in the terminal accommodating chamber 12.

Other configurations are the same as in Example 1, and the same components as in Example 1 are denoted by the same reference numerals.

As illustrated in FIG. 12, the engaging member 60 includes a terminal posture correction portion 61, in addition to a terminal guide/engaging section 51, a temporary engaging projection 54 and the final engaging projection 55, and an operating portion 56.

The terminal posture correction portion 61 is a part in which a terminal posture correction contact surface 61*b* is formed to rotate the terminal 100 so that the apex 53 is in the engaging position which projects toward the bottom wall 131*a* between the pair of uprise walls 131*b* and 131*b* in the final engaging position, by being in contact with the bottom surface of the core wire crimping section 121 of the terminal 100 which is inclined relative to an engaging posture in the rotating direction of which the rotating axis is a straight line extending in the inserting direction by sliding from the temporary engaging position to the final engaging position.

The terminal posture correction portion 61 includes a slide main body 61*a* which extends in the sliding direction of the engaging member 60 by overlapping the slide main body 51*a* of the terminal guide/engaging section 51 and the terminal posture correction portion 61 with each other, and is provided to be aligned along the direction in which the terminal posture correction contact surface 61*b* is slid in the slide main body 61*a* and to have a line-symmetrical shape to a straight line along the sliding direction.

More specifically, the terminal posture correction contact surface 61*b* is a surface formed to the slide main body 61*a* so that the terminal posture correction contact surface 61*b* has a shape inclined upwardly from the portion which begins to contact the bottom surface of the core wire crimping section 121, toward the rear side from the front side of the sliding direction, by sliding from the temporary engaging position to the final engaging position.

An inclined angle and a surface shape of the terminal posture correction contact surface 61*b* may be suitably adjusted according to the shape of the terminal 100.

Next, a procedure in which the terminal 100 is engaged in the terminal accommodating chamber 12 by the engaging member 60 after the terminal 100 is accommodated in the terminal accommodating chamber 12 will be described.

The connector housing 10 is in a state where attachment of the engaging member 60, the fitting side seal member 20, the electric wire pull-out side seal member 30, and the cover member 40 to the connector housing 10 is completed. In addition, the engaging member 60 is disposed on the temporary engaging position.

First, the operator inserts the terminal 100 of each of the terminal attached electric wires CW from the electric wire inserting hole 40*a* of the cover member 40 and then pushes up to the inserting completion position in the terminal accommodating chamber 12.

At this time, since the engaging member 60 is in the temporary engaging position, the engaging member 60 generally forms a circular inner wall surface by each circular arc-shaped curved surface 52 of the engaging member 60 being fitted together the circular arc-shaped curved surface of the engaging member inserting space 14*a*. Therefore, the terminal 100 is capable of smoothly sliding up to an inserting completion position of the terminal accommodating chamber 12 without rattling in the engaging member inserting space 14*a*. In other words, each circular arc-shaped curved surface 52 of the engaging member 60 serves a guide function to induce the terminal 100 in the inserting direction (see FIG. 13A).

The terminal 100 may be accommodated in an inclined state with respect to the normal posture in the rotating direction, since the posture in the rotating direction of which the rotating axis is a straight line extending in the inserting direction by the engaging member 60 later can be corrected to the normal posture. Therefore, the terminal 100 is capable of being inserted up to an inserting completion position of the terminal accommodating chamber 12 without worrying about the posture in the rotating direction.

The operator allows each terminal 100 to be engaged in the terminal accommodating chamber 12 by sliding the engaging member 60 to the final engaging position, after the terminal 100 is accommodated in the entirety of the terminal accommodating chamber 12 (see FIG. 13B).

At this time, in a case where the terminal 100 is accommodated in the terminal accommodating chamber 12 in the inclined state with respect to the normal posture in the rotating direction of which the rotating axis is a straight line extending in the inserting direction, as illustrated in FIG. 14A, when the engaging member 60 begins to slide from the temporary engaging position toward the final engaging position, the terminal posture correction contact surface 61*b* begins to be in contact with the bottom surface of the core wire crimping section 121 (see FIG. 14A).

Further, when the engaging member 60 is slid toward the final engaging position, since the terminal posture correction contact surface 61*b* is slid while being in contact with the outer peripheral surface of the core wire crimping section 121, the terminal 100 rotates by an external force in the direction in which the terminal 100 is rotated being applied to the core wire crimping section 121 (see FIG. 14B).

Further, when the engaging member 60 is slid up to the final engaging position, the terminal 100 is rotated so that the apex 53 of the terminal 100 is positioned in the engaging position projecting between the pair of uprise walls 131*b* and 131*b* toward the bottom wall 131*a*.

At this state, the terminal 100 is engaged by the terminal guide/engaging section 51 of the engaging member 60.

In the connector 2 according to Example 2 of the present invention, in the same manner as the connector 1 of Example 1, even if the connecting part with the connection mating terminal is a terminal 100 having a cylindrical shape, the rotation of the terminal 100 in the terminal accommodating chamber 12 can be reliably suppressed while being easily inserted to the terminal accommodating chamber 12, in addition, when the engaging member 50 is slid from the temporary engaging position to the final engaging position, the posture of the terminal 100 can be corrected to the normal posture at the rotating direction of which the rotating axis is a straight line extending in the inserting direction by the terminal posture correction portion 61. Therefore, the terminal 100 is capable of being inserted up to an inserting completion position of the terminal accommodating chamber 12 without worrying about the posture in the rotating direction. As a result, the operation of inserting the terminal 100 into the terminal accommodating chamber 12 can be easily performed.

In the connectors 1 and 2 according to Examples 1 and 2 of the present invention, six terminal accommodating chambers 12 are provided in the connector housing 10, as an example. However, the number of the six terminal accommodating chambers 12 is not limited to this, and at least one terminal accommodating chamber 12 may be provided in the connector housing 10. In this case, the engaging members 50 and 60 may include apexes 53 of the terminal guide/engaging section 51, or the terminal posture correction contact surfaces 61*b* of the terminal posture correction portion 61 by the number corresponding to the number of terminal accommodating chambers 12.

In addition, in the connectors 1 and 2 according to Examples 1 and 2, the crimping section 120 of the terminal 100 includes the core wire crimping section 121 and covering crimping section 122, and the connectors are crimped to the distal end portion of the electric wire W by the crimping parts in the two places, as an example. However, it is not limited to this, and if there is a portion corresponding to the first coupling section 131, the crimping section 120 may be only one place.

Although the invention made by the present inventors has been concretely described based on the examples of the invention described above, the present invention is not limited to the examples of the invention described above, various modifications are possible in the range without departing from the subject matter of the present invention.

What is claimed is:

1. A connector comprising:

at least one terminal that has a cylindrical connecting section which constitutes a connecting part with a connection mating terminal, and a pair of uprise walls which connect between the connecting section and a crimping section to an electric wire so that bottom surfaces of the connecting section and the crimping section are continuous with each other and in which both edges of a bottom wall forming the bottom surface stand upright along a circular end surface of the connecting section;

a connector housing that has at least one terminal accommodating chamber in which the terminal is accommodated;

an engaging member that is mounted on the connector housing so as to be slidable between a temporary engaging position and a final engaging position in a direction perpendicular to an inserting direction of the terminal to the terminal accommodating chamber, and includes a terminal guide/engaging section which has circular arc-shaped curved surfaces formed along the direction perpendicular to the inserting direction adjacent to each other and an apex formed continuously with the circular arc-shaped curved surfaces between the adjacent circular arc-shaped curved surfaces, the circular arc-shaped curved surfaces being able to induce the terminal to an inserting completion position toward the terminal accommodating chamber when the engaging member is at the temporary engaging position, the terminal guide/engaging section engaging the terminal with the apex disposed on a position to project toward the bottom wall between the pair of uprise walls when the engaging member is at the final engaging position such that one of the pair of upright walls engages a respective one of the circular arc-shaped curved surfaces if the terminal rotates about a straight line extending in the insertion direction.

2. The connector according to claim 1, wherein a plurality of terminal accommodating chambers are formed along a sliding direction of the engaging member, wherein the terminal guide/engaging section is formed so as to arrange a plurality of apexes along the sliding direction so that a plurality of terminals accommodated in the plurality of terminal accommodating chambers are engaged.

3. The connector according to claim 1, wherein the engaging member has a terminal posture correction portion on which a terminal posture correction contact surface is formed to rotate the terminal so that the apex is in an engaging position to project toward the bottom wall between the pair of uprise walls in the final engaging position, by being in contact with the bottom surface of the crimping section of the terminal which is inclined relative to a normal posture in a rotating direction in which a straight line extending in the inserting direction as the rotating axis by sliding from the temporary engaging position to the final engaging position.

* * * * *